US007606286B2

(12) United States Patent
Elliott

(10) Patent No.: US 7,606,286 B2
(45) Date of Patent: Oct. 20, 2009

(54) CORELESS FURNACE COIL CLAMP

(75) Inventor: James Evans Elliott, Cortland, OH (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 317 days.

(21) Appl. No.: 11/448,698

(22) Filed: Jun. 7, 2006

(65) Prior Publication Data

US 2007/0286253 A1 Dec. 13, 2007

(51) Int. Cl.
*H05B 6/22* (2006.01)

(52) U.S. Cl. ..... 373/151; 373/152; 373/153

(58) Field of Classification Search ..... 373/151, 373/152, 153, 154, 166, 138, 139, 141–150; 219/672–677; 266/242, 275, 276; 336/207, 336/205, 206, 199; 248/317, 340, 610, 612, 248/613

See application file for complete search history.

(56) References Cited

U.S. PATENT DOCUMENTS

| | | | | |
|---|---|---|---|---|
| 2,852,587 | A | 9/1958 | Junker | |
| 3,303,258 | A | 2/1967 | Junker | |
| 4,622,679 | A | 11/1986 | Voss | |
| 5,272,720 | A | 12/1993 | Cignetti et al. | |
| 5,416,794 | A | 5/1995 | Cignetti et al. | |
| 5,425,048 | A * | 6/1995 | Heine et al. | 373/151 |

* cited by examiner

*Primary Examiner*—Quang T Van
(74) *Attorney, Agent, or Firm*—Fay Sharpe LLP

(57) ABSTRACT

A coreless induction furnace includes a crucible for holding a material to be heated. An induction coil is wound about the crucible. A frame supporting the crucible and the induction coil is wound about the crucible. An induction coil loading arrangement includes at least one clamping assembly for providing a leveraged axial force to an upper side of the induction coil.

18 Claims, 4 Drawing Sheets

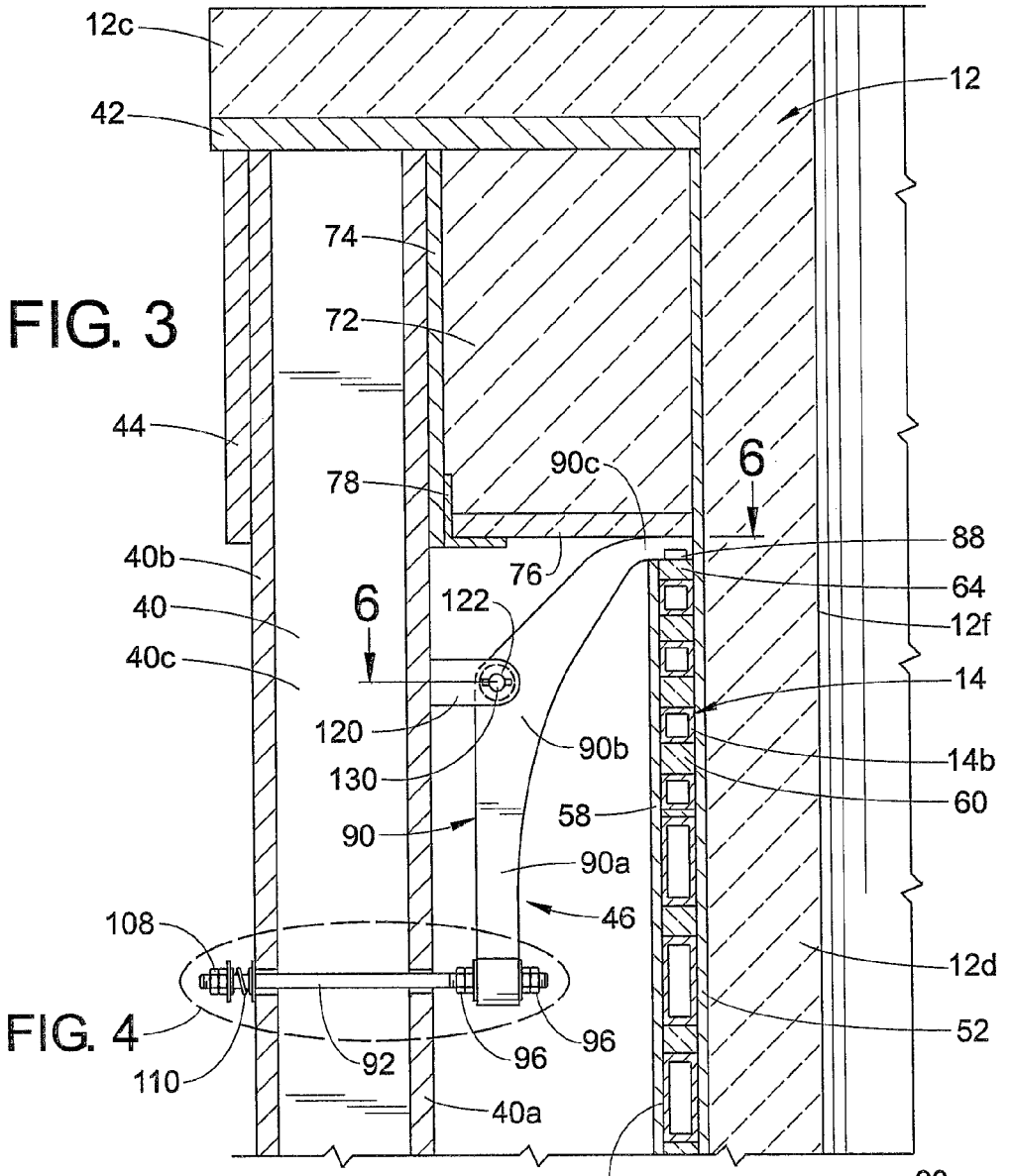
FIG. 3
FIG. 4
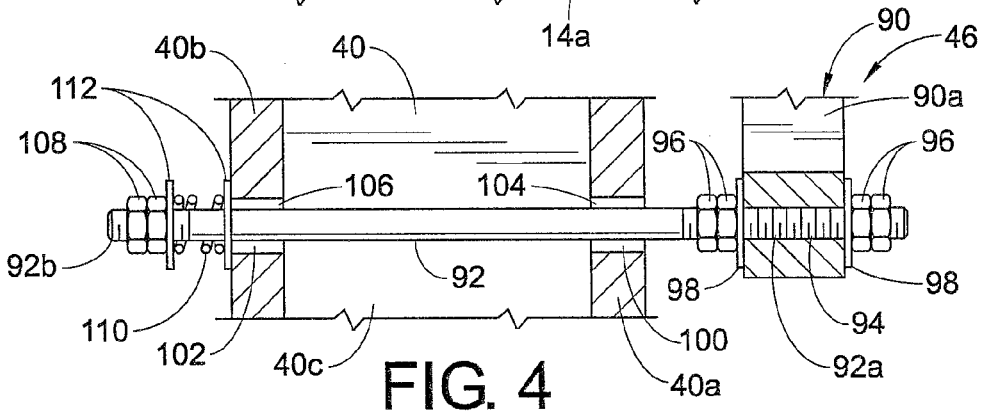
FIG. 4

CORELESS FURNACE COIL CLAMP

BACKGROUND

The present disclosure generally relates to coreless induction furnaces and relates more particularly to an improved mounting or loading arrangement for an induction coil in a coreless induction furnace. In one embodiment, the coreless induction furnace includes a crucible, an induction coil wound about the crucible, a frame supporting the crucible and the induction coil, and an improved induction coil loading arrangement including at least one clamping assembly for providing a leveraged axial force to an upper side of the induction coil. The improved induction coil loading arrangement will be described with particular reference to this embodiment, but it is to be appreciated that it is also amenable to like applications.

A typical problem faced by designers of coreless furnaces is how to secure the power and cooling coils of the coreless furnace. It is well known that vibration must be controlled when designing the assembly of a coreless furnace coil. If not, mechanical and electromotive forces causing heavy vibrations can lead to premature failure of the coreless furnace coil. By way of example, forces on a single coil of a coreless furnace often reach 2,500 pounds and can sometimes be as large as 5,000 pounds.

One electromagnetic force encountered in coreless furnaces is a compressive force on the coreless furnace's coil that goes to a maximum and returns to zero on each electrical cycle. A typical furnace operating at 300 Hz would have over 1,000,000 cycles per hour or about 12,000,000 cycles if operated for about one half day. For typical fatigue applications, 10-20 million cycles is considered large and, in the case of a conventional coreless furnace, would be met in a day or so of operation.

A common method of reducing fatigue on a member is to retain the member, or the coil in a case of a coreless furnace, at a level so that it does not change state, i.e., a stress going from negative (i.e., compression) to positive (i.e., tension) and to minimize the variation of that stress. For a coreless furnace coil, a force is applied axially to the coil of sufficient magnitude such that the stress on the coil does not return to "zero" and thus the coil is always maintained in compression. Prior art coreless furnace designs applied force directly to the coil utilizing shunts which, generally, are not rigid and are only retained radially to the frame (i.e., not axially). In some limited coreless furnace designs, the coil is retained axially, i.e., from the top and the bottom, but it is generally still free to move relative to the furnace's refractory or the furnace proper.

One conventional means of clamping the coreless furnace's coil was by applying a constant upward force on the power and cooling coils. The clamp applying such a force included a spring-loaded lever mounted near a floor of the furnace for providing a constant upward positive force on the coil. While this conventional means does initially provide the desired positive force on the coil, it is subsequently compromised when the furnace's refractory, which is located above the top of the coil, begins to lift and warp due to the heat and vibration that occurs during operation of the furnace. As a result, operators soon find that they constantly must adjust the set-up torque of the clamp. This can lead to a further problem. That is, when adjusting the set-up torque, over adjustment (e.g., applying too great of a torque during adjustment) can cause lifting of the upper furnace refractory resulting in an impossible condition where the correct positive clamping force cannot be achieved. Due to the afore-mentioned drawbacks, the power level of the coreless furnace had to be limited (e.g., to under 8 MW) to keep furnace from self-destructing.

SUMMARY

According to one aspect, a coreless induction furnace is provided. More particularly, in accordance with this aspect, the coreless induction furnace includes a crucible for holding a material to be heated. An induction coil is wound about the crucible. A frame supporting the crucible and the induction coil is wound about the crucible. An induction coil loading arrangement includes at least one clamping assembly for providing a leveraged axial force to an upper side of the induction coil.

According to another aspect, an induction coil loading arrangement is provided for a coreless induction furnace having a crucible and an induction coil wound about the crucible. More particularly, in accordance with this aspect, the loading arrangement includes a frame for supporting the crucible and the induction coil. At least one clamping assembly is connected to the frame for applying an axial force onto the induction coil. The at least one clamping assembly includes a lever pivotally secured to the frame. The lever has a first portion connected to the frame so as to be urged in a direction radially away from the induction coil and a second portion extending toward the induction coil for applying the axial force onto the induction coil.

According to yet another aspect, a coreless induction furnace having an induction coil loading arrangement is provided. More particularly, in accordance with this aspect, the coreless induction furnace having an induction coil loading arrangement includes a crucible for holding a material to be heated. An induction coil is wound about the crucible. A frame supporting the crucible and the induction coil is wound about the crucible. A plurality of planting assemblies provides a leveraged axial force to an upper side of the induction coil. Each of the plurality of clamping assemblies has a lever in a pivotal connection between the lever and the frame. The lever has a first leg extending downward relative to the pivotal connection in a second leg extending toward an upper axial end of induction coil. The pivotal connection allows a force applied to the lever first leg to be leveraged and applied to the upper axial end of the induction coil.

BRIEF DESCRIPTION OF THE DRAWINGS

FIG. 3 is an enlarged partial cross-sectional elevation view of a selected one of the clamp assemblies of FIG. 1 shown applying a downward force on the induction coil assembly.

FIG. 4 is an enlarged partial cross-sectional elevation view of the clamp assembly of FIG. 3 showing a lever of the clamp assembly being urged toward an adjacent vertical frame member of the induction furnace.

DETAILED DESCRIPTION

Figure 1:
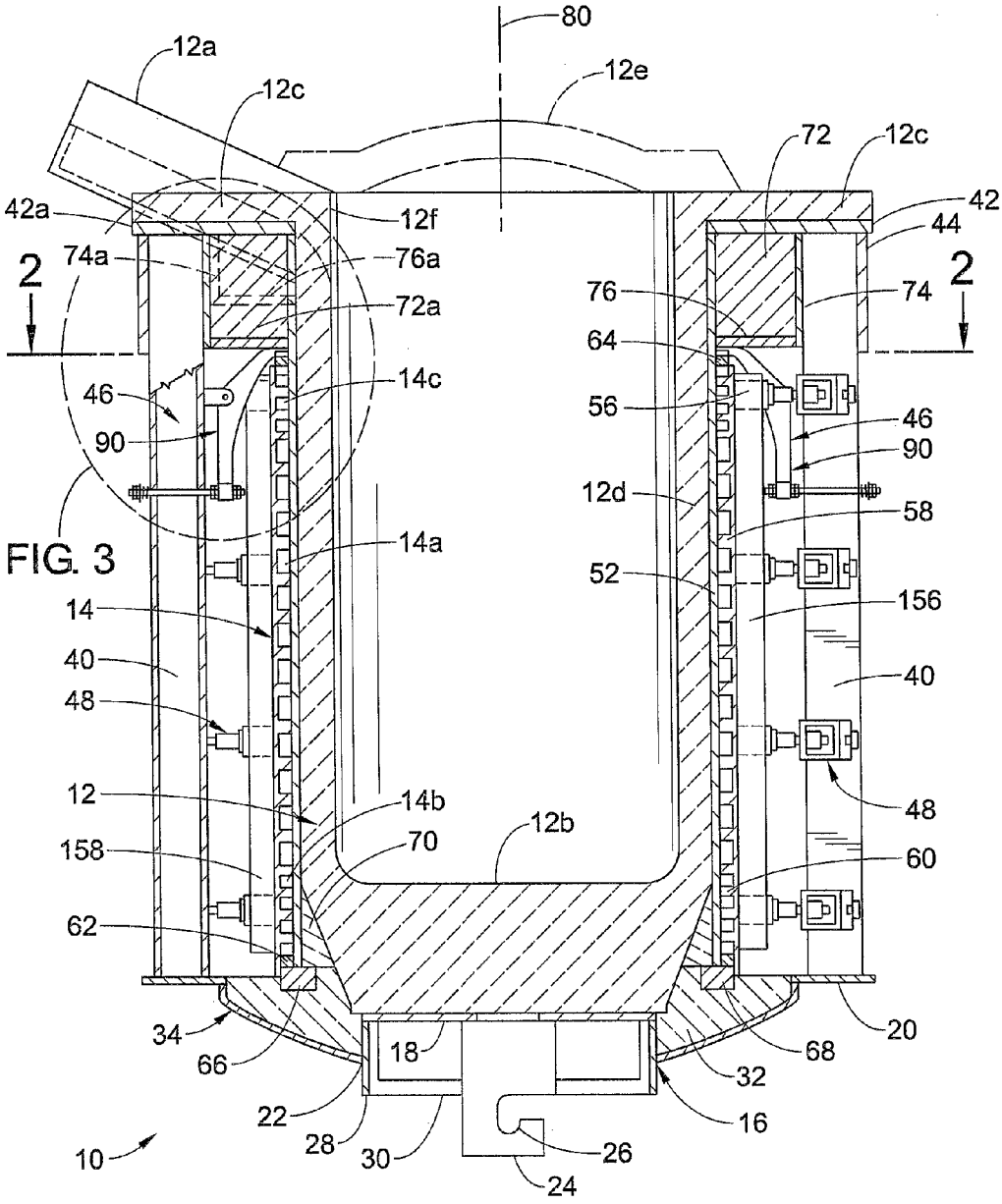
FIG. 1 is a cross-sectional elevation view of an induction furnace having an induction coil assembly against which forces are applied by a plurality of clamp assemblies and a plurality of intermediate yoke assemblies.

Referring now the drawings wherein the showings are for the purposes of showing one or more exemplary embodiments only and not for limiting the scope of the appended claims, FIG. 1 shows a coreless induction furnace generally designated by reference numeral 10. In the illustrated embodiment, the furnace 10 generally includes a crucible 12 formed of a refractory material for holding a material to be heated, an induction coil assembly 14 wound or coiled about the crucible and a frame 16, such as a steel frame, for supporting the crucible 12 and the coil assembly 14. As will be described in more detail below, the furnace 10 further includes an induction coil loading arrangement including at least one clamping assembly for providing a leveraged axial force to an upper side of the induction coil 14. If desirable, the crucible 12 can include a spout portion 12*a* and a monolithic liner 12*f*, such as a monolithic liner formed of a refractory material and fired in place.

The frame 16, also referred to herein as the furnace body, can include a frame plate 18, which can be a heavy structural steel plate, upon which a bottom portion 12*b* of the crucible 12 can rest and be supported. The frame 16 can further include an annular flange portion 20 connected to the frame plate 18 by a frame bottom portion 22. Alternatively, the bottom portion 22 can be considered to include the frame plate 18 and/or the flange portion 20. A tilting support 24 defining a recess 26 is disposed within a sleeve 28 of the frame bottom portion 22 and immediately below the frame plate 18. A support 30 can also be disposed within the sleeve 28 for snuggly holding the tilting support 24 in position. The frame 16, and specifically the frame bottom portion 22, holds a heat insulating member 32 annularly about the crucible base portion 12*b*. More particularly, the heat insulating member 32 resides between the sleeve 28 and wall 34 of the frame bottom portion 22. In one embodiment, the heat insulating member 32 can be pre-cast prior to installation on the frame 16.

As shown, a plurality of vertical frame members 40, also referred to herein as support columns or supports, extends upward from the frame flange portion 20 to a support plate 42, which can be a heavy structural steel plate, upon which a top flange portion 12*c* of the crucible rests and/or is supported. A skirt 44 can depend downwardly from a peripheral edge 42*a* of the support plate 42 and radially outside the supports 40 to limit radially movement of the plate 42 with respect to the supports 40. As will be described in more detail below, a plurality of clamping assemblies 46 and intermediate yoke assemblies 48 can be mounted to and supported by the supports 40, which themselves can be considered as included by the frame 16.

The crucible 12, which can alternately be referred to as a refractory, is radially surrounded by the induction coil 14, which is comprised of a plurality of windings. More particularly, an active current-receiving coil or coil portion 14*a* is helically wound to radially surround a cylindrical wall portion 12*d* of the crucible 12 and is axially flanked by cooling coils or coil portions 14*b*, 14*c* which radially surround the crucible 12 and are usually not provided with current. The induction coil 14 can be radially separated or spaced from the crucible by layer 52, such as a layer of mica. Intermediate yokes 56 of the intermediate yoke assemblies 48 can similarly be radially separated or spaced from the induction coil 14 by a layer 58, such as a layer of grout material. As illustrated, grout material 60, which can be integrally provided with the layer 58, can also be used to axially insulate between the coil portions 14*a*, 14*b*, 14*c* and between the individual windings of each coil portion 14*a*, 14*b*, 14*c*.

As shown in the illustrated embodiment, insulating rings 62,64 can be provided at respective ends of the induction coil 14. The lower insulating ring 62 separates the induction coil 14 from a lower annular support 66, which is received within a groove 68 defined in the insulating member 32, that can be a heavy structural ring that resists any forces or movements imported from the induction coil assembly 14. Wedged between the lower support 66, the insulating member 32, the layer 52 (separating the crucible sleeve portion 12*d* from the induction coil 14), and the crucible 12 is an insulating member 70, which can be formed of a pre-cast grouting material into the illustrated wedge shape. An upper insulating member 72 is disposed annularly about the crucible 12 adjacent the support plate 42. The upper insulating member 72 is held in the illustrated position by frame members 74,76 of the frame 16. As shown, the upper insulating member 72 and the frame members 74,76 can be appropriately shaped (at 72*a*, 74*a* and 76*a*) to permit passage by the crucible spout 12*a*. A suitable angle member or members 78 (FIG. 3) can be used to secure support member 76 to vertical support member 74. If desired, the crucible 12 can include a suitable cap 12*e* for retaining materials placed within the crucible.

Figure 2:
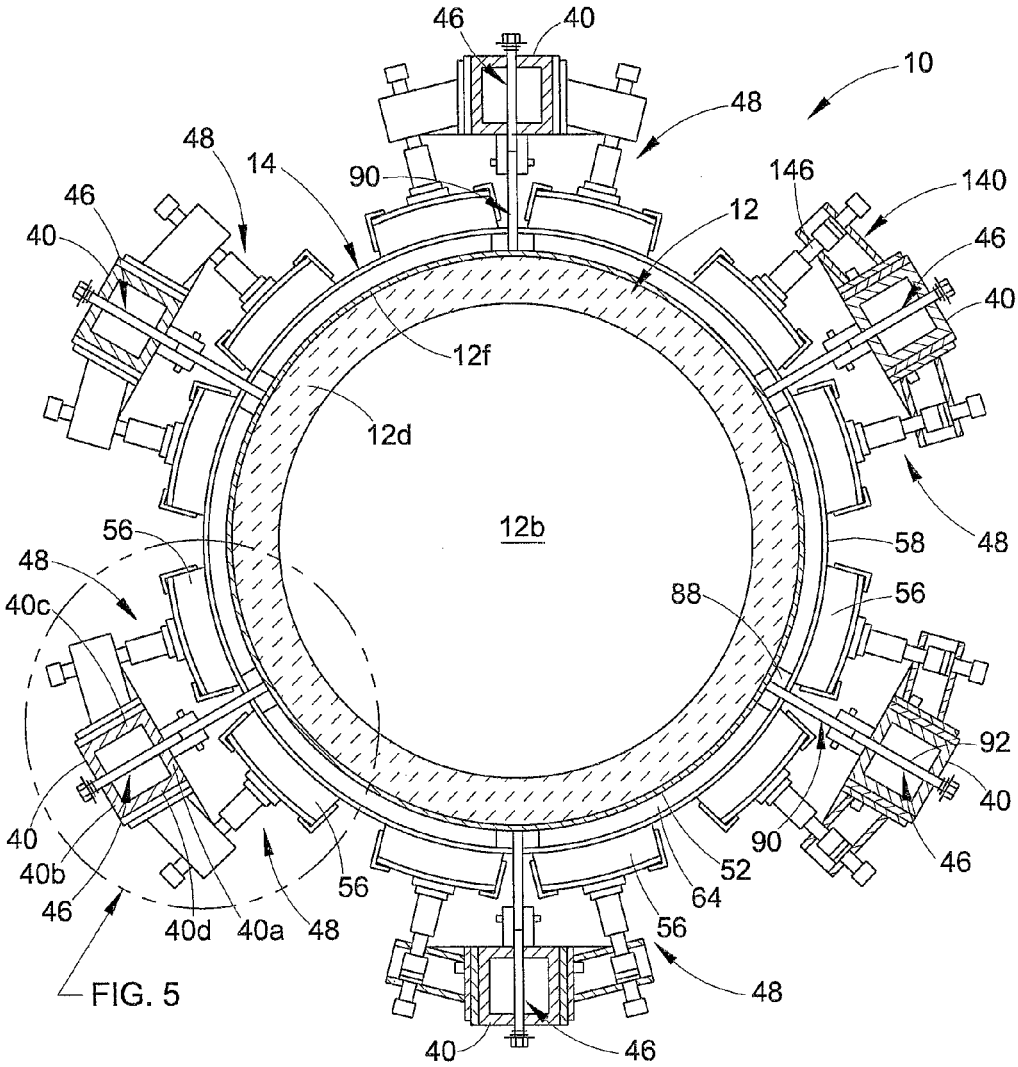
FIG. 2 is a cross-sectional plan view of the induction furnace taken along the line 2-2 of FIG. 1 further showing the clamp assemblies and intermediate yoke assemblies.

With additional reference to FIG. 2, the plurality of support columns 40 are circumferentially or angularly spaced about a central axis 80 (and apart relative to one another) and spaced radially outwardly relative to the crucible 12 and the induction coil 14. In the illustrated embodiment, six (6) such support columns 40 are provided, each with a clamp assembly 46 and several pairs of intermediate yoke assemblies 48 vertically spaced therealong. For example, each illustrated column 40 includes one (1) clamp assembly 46 and four (4) pairs of vertically spaced intermediate yoke assemblies 48 (with each pair flanking its corresponding column). As shown, each column 40 can be generally hollow and include an inner wall 40*a*, an outer wall 40*b* and spaced side walls 40*c*, 40*d* connecting the inner and outer walls.

With still additional reference to FIG. 3, the illustrated clamping assembly 46, which can be the same as and therefore representative of the remaining clamp assemblies 46, includes a lever 90 pivotally mounted to its adjacent support column 40. In particular, the lever 90 has a lower portion or leg 90*a* movably connected to the support column 40 so as to be urged toward the support column, a pivotally connected mounting portion 90*b*, and an upper portion or leg 90*c* for applying a downward force on the induction coil 14 (i.e., the side adjacent an open end of the crucible 12). The lower lever leg 90*a* extends along a longitudinal length of the adjacent support column 40 and the upper lever leg 90*c* extends from the pivotal connection between the lever 90 and the support column 40 toward the induction coil. The mounting of the lever 90 to the column 40 is such that the lever is able to apply a constant positive loading on an upper axial side of the induction coil 14. A force applying member 88 can be mounted to distal end of the lever leg 90*c* (i.e., end of leg 90*c* distal relative to mounting portion 90*b*) for purposes of supplying greater contact area between the lever 90 and the insulating ring 64, which is immediately adjacent the induction coil 14. This has the effect of angularly or circumferentially spreading the loading applied by the clamp assemblies 46.

With further reference to FIG. 4, in the illustrated embodiment, the lever 90 is mounted in urging relation relative to the adjacent hollow support 40 by a spring-urged rod or shaft 92. The rod 92, which extends in a direction approximately normal relative to the adjacent support column 40 and the lever lower leg 90*a*, has a first threaded end 92*a* received through an aperture 94 defined in the lever leg 90*a*, also referred to herein as a lever first leg. Threaded members 96 (such as the illustrated nuts) can be used to secure the rod 92 to the lever 90. As illustrated, nuts 96 can be provided in pairs on either side of the lever 90, optionally with the illustrated washers 98. As shown, the rod 92 can be received through apertures 100,102 defined in the walls 40*a*, 40*b* of the support. Annular bearings 104,106 can be positioned radially about the rod 92 to provide a sliding but guided fit between the rod 92 and the walls 40*a*, 40*b*.

Additional threaded members 108 (such as the nuts illustrated), can be threadedly secured on an opposite or second threaded end 92*b* of the rod. Like nuts 96, nuts 108 can be provided in pairs so as to be disposed in locking relation. To provide the urging force on the lever lower leg 90*a*, a compression spring 110 is annularly disposed about the rod 92 between the nuts 108 and the outer wall 40*b*. In one embodiment, the compression spring 110 can exert a spring force of about 750 pounds, which is applied to the lower lever leg 90*a*. Optionally, washers 112 can be provided about the rod 92 so as to axially flank the spring 110. The compression spring 110 acts against the fixedly provided column wall 40*b* and the nuts 108 so as to urge the rod 92 and thereby the lever lower leg 90*a* in a radially outward direction relative to the axis 80 (i.e., to the left in FIG. 4).

Figure 5:
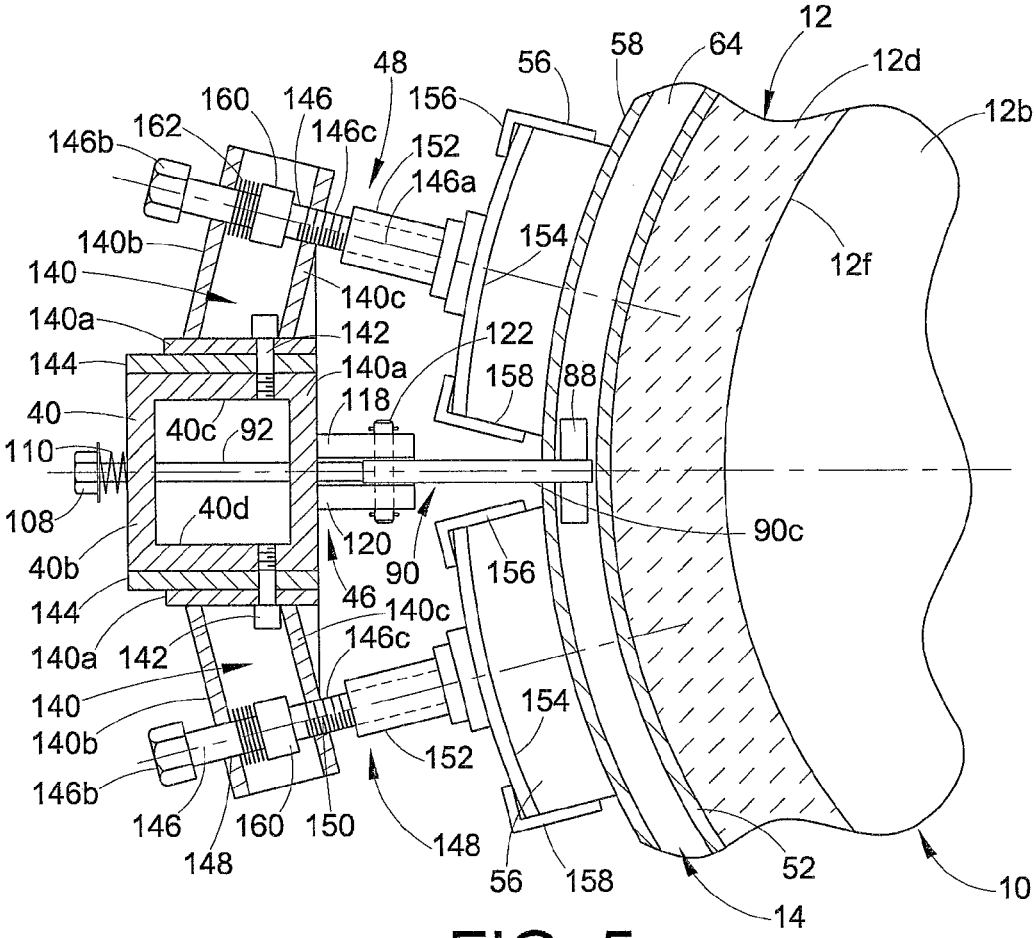
FIG. 5 is an enlarged partial cross-sectional plan view of a selected one of the intermediate yoke assemblies and clamp assemblies of FIG. 2.
Figure 6:
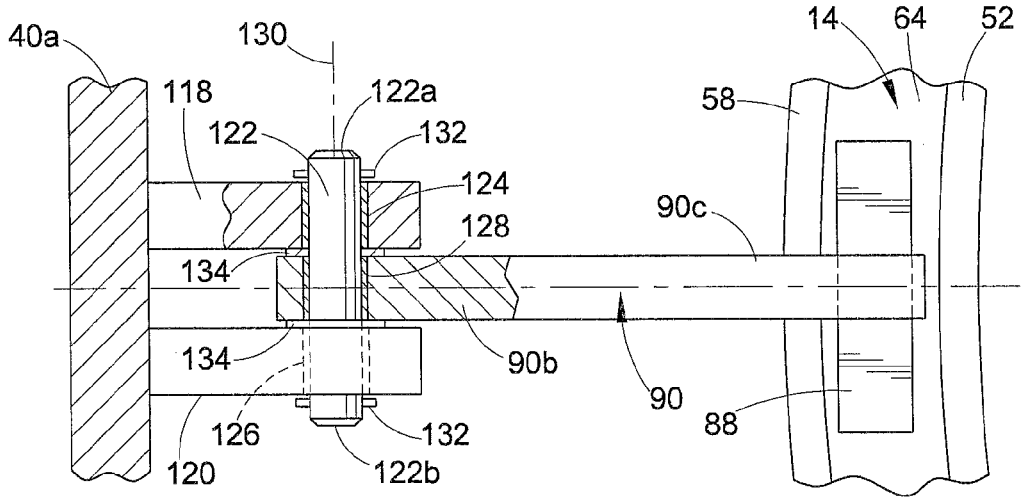
FIG. 6 is an enlarged partial cross-sectional plan view taken along the line 6-6 of FIG. 3 showing a lever of the clamp assembly of FIG. 5 pivotally mounted to the adjacent vertical frame member.

With reference now to FIGS. 5 and 6, a pair of spaced apart mounting arms 118,120 extend radially inwardly from the column wall 40*a* in the illustrated embodiment. A pivot pin or pintle 122 extends through apertures 124,126 defined in the mounting arms 118,120, as well as through an aperture 128 defined in the lever mounting portion 90*b*, so as to pivotally mount the lever 90 to the column 40 and create a fulcrum at axis 130 (i.e., the pivotal connection). Lock or retaining pins 132 can be installed adjacent ends 122*a*, 22*b* of the pin 122 to limit axial displacement of the pin 122 relative to the arms 118,120. Additionally, as shown, spacers or washers 134 can be disposed between each of the mounting arms 118,120 and the lever 90. As a result of the spring-loaded rod 92 applying a force on the lower lever leg 90*a* and the pivotal mounting of the lever 90 to the arms 118,120 of the adjacent support column 40, leveraged force is applied by the upper lever leg 90*c* and the force applying member 88 secured thereto in a downward direction to the induction coil 14 (through insulating ring 64). In one embodiment, the spring-loaded rod 92 applies a 750 pound spring force to the lower lever leg 90*a*, which is leveraged to 1,300 pounds applied to the induction coil 14 by the upper lever leg 90*c* and the force applying member 88.

Mounting arm support structures 140, which include base wall 140*a* and spaced apart angularly disposed walls 140*b*, 40*c*, are secured to respective side walls 40*c*, 40*d* of each support column 40. In the illustrated embodiment, each support structure 140 is secured to a respective side wall 40*c*, 40*d* by a suitable fastener, such as bolt 142, and a mounting plate 144 is provided between the base wall 140*a* and the respective side wall 40*c* or 40*d*. Each intermediate yoke assembly 48, which can include the mounting arm support structure 140, includes a corresponding intermediate yoke 56 secured to an adjacent mounting arm structure 140 so as to urge the yoke 56 radially inwardly into the induction coil 14 and toward the crucible 12.

More particularly, each yoke assembly 48 includes a threaded rod or bolt 146 received through aligned apertures 148,150 defined in the walls 140*b*, 140*c* of the yoke assembly's mounting structure 140. A distal bolt end 146*a* (opposite bolt head 146*b*) is received in a support structure or shoe 152, which can be fixedly secured, such as by welding, to intermediate yoke base plate 154. Angle members 156,158 can be fixedly secured, such as by welding, to the base plate 154 to as to capture the intermediate yoke 56 against the induction coil 14 (though the yoke 56 is spaced from the induction coil 14 by the layer 58). With brief reference to FIG. 1, the angle members 156,158 can be elongated so as to capture a plurality of vertically spaced and aligned yokes 56 therebetween. Returning to FIGS. 5 and 6, a threaded member 160, such as a nut, is threadedly received on a threaded portion 146*c* of the bolt 146 and positioned between the walls 140*b*, 140*c*. Compression spring 162 is disposed between the nut 160 and the wall 140*b* so as to urge the bolt 146 radially inwardly and thereby urge the yoke 56 radially toward the induction coil 14. As is known, each of the intermediate yokes 56 can be formed of stacked plates and can serve as a radial support for the induction coil 14 and also for magnetic field force guiding.

In the illustrated embodiment, a clamping assembly 46 is provided with each of the six (6) support columns such that there are a total of six (6) clamping assemblies 46. In one embodiment, each clamping assembly 46 can exert about 1,300 pounds of downward directed force to the induction coil 14 and where six (6) clamping assemblies 46 are used a total of 7,800 pounds of downward force can be applied to the induction coil 14, having the effect of firmly retaining the induction coil 14 and increasing the life of the induction coil 14, crucible 12 and other components of the furnace 10 (e.g., the liner 12*f* and layers 58,60). Of course, the number of clamping assemblies 46 can vary, as can the number of support columns 40 (and a clamping assembly need not be provided on every provided support column). For example, the induction furnace 10 can include eight (8) support columns 40 and six (6) or eight (8) clamping assemblies 46 could be distributed about the eight (8) support columns 40. In any case, unlike conventional methods of applying a clamping load to a lower end of an induction coil, the clamping assemblies 46 of the illustrated embodiment apply a clamping load on an upper end of the induction coil 14, which eliminates the disadvantage of prior art clamping assemblies tending to lift the crucible up and out of the furnace in which it was employed.

The spring-loaded rod 92 of each clamping assembly 46 applies an input load to the clamping assembly's lower lever leg 90*a* which, due to the pivotal mounting of the lever 90, causes the upper lever leg 90*b* to induce a leveraged constant positive downward loading or force onto the top or upper end of the induction coil 14. Thus, a much larger force can be exerted to clamp the induction coil 14 which advantageously maintains the coil in compression at all times (i.e., the compression force on the induction coil 14 does not go negative or to tension, or even to zero). This has been found to greatly reduce fatigue in the components of the furnace 10.

As illustrated, a lower end of the induction coil 14 is captured (i.e., axially fixed) and mechanically supported by the plate 18, which has the effect of eliminating or at least substantially reducing the likelihood of crucible deformation. Stated alternatively, the induction coil 14 is pressed against the bottom of the furnace, i.e., the lower frame portion 22, which is a welded integral part of the frame 16, to retain the coil 14 in a fixed position with respect to the crucible lining 12*f*, the frame 16 and the upper furnace structure. This removes the need for constant torque adjustments to be made with respect to the plurality of clamp assemblies provided for applying a constant force on the induction coil 14. Additionally, by maintaining a constant positive force on the induction coil 14, the life of the mechanical components of the furnace 10 are significantly extended. Still further advantages of the presently disclosed clamping arrangement include allowing the furnace 10 to run at higher power levels (for example 10-11 MW) with reduced likelihood of mechanical failure at such higher power levels and quieter operation of the furnace 10.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A coreless induction furnace, comprising a crucible for holding a material to be heated;

an induction coil wound about said crucible;

a frame supporting said crucible and said induction coil wound about said crucible; and an induction coil loading arrangement including at least one clamping assembly applying a leveraged axial force to an upper side of said induction coil, wherein said at least one clamping assembly includes a lever pivotally mounted to said frame with a first leg having a spring force applied thereto and a second leg applying said leveraged axial force downwardly on said induction coil due to said lever being pivotally mounted to said frame.

2. The coreless induction coil of claim 1 wherein a lower end of said induction coil is generally axially fixed and said leveraged axial force on said upper side of said induction coil maintains said induction coil in compression.

3. The coreless induction coil of claim 2 wherein a support plate is provided adjacent said lower end of said induction coil to limit axial movement of said induction coil thereby.

4. A coreless induction furnace, comprising a crucible for holding a material to be heated;

an induction coil wound about said crucible;

a frame supporting said crucible and said induction coil wound about said crucible, said frame including a plurality of support columns spaced radially outward relative to said induction coil and spaced apart circumferentially relative to one another; and an induction coil loading arrangement including at least one clamping assembly applying a leveraged axial force to an upper side of said induction coil, said at least one clamping assembly mounted to each of said plurality of support columns to provide said leveraged axial force to said upper side of said induction coil, wherein each of said at least one clamping assembly includes a lever pivotally mounted to a corresponding one of said plurality of support columns, said lever having a first leg with a spring force applied thereto and a second leg applying said leveraged axial force downwardly on said induction coil due to said lever being pivotally mounted to said frame.

5. The coreless induction furnace of claim 4 wherein each of said at least one clamping assembly further includes a spring-urged rod mounting said first leg to said corresponding one of said plurality of support columns.

6. The coreless induction furnace of claim 5 wherein said first leg extends along a longitudinal length of said corresponding one of said plurality of support columns and said second leg extends from a pivotal connection between said lever and said corresponding one of said plurality of support columns toward said induction coil.

7. The coreless induction furnace of claim 6 wherein said spring-urged rod extends in a direction approximately normal relative to said corresponding one of said plurality of support columns and said first leg.

8. A coreless induction furnace, comprising:

a crucible for holding a material to be heated;

an induction coil wound about said crucible;

a frame supporting said crucible and said induction coil wound about said crucible;

an induction coil loading arrangement including at least one clamping assembly for-providing a leveraged axial force to an upper side of said induction coil; and said at least one clamping assembly including a lever pivotally mounted to said frame for applying said leveraged axial force downwardly on said induction coil, said lever having a first leg urged radially outwardly relative to said induction coil and a second leg extending toward said induction coil that applies said leveraged axial force downwardly on said induction coil due to said lever being pivotally connected to said frame and said first leg being urged radially outwardly.

9. The coreless induction coil of claim 8 wherein said first leg is connected to said frame by a spring-urged rod that applied a spring force of about 750 pounds to said first leg and said leveraged axial force is about 1,300 pounds.

10. An induction coil loading arrangement for a coreless induction furnace having a crucible and an induction coil wound about the crucible, said loading arrangement comprising:

a frame for supporting the crucible and the induction coil; and at least one clamping assembly connected to said frame for applying an axial force onto the induction coil, said at least one clamping assembly including a lever pivotally secured to said frame, said lever having a first portion connected to said frame so as to be urged in a direction radially away from the induction coil and a second portion extending toward the induction coil for applying said axial force onto the induction coil.

11. The induction coil loading arrangement of claim 10 wherein a spring-urged rod connects said lever first portion to said frame and urges said lever first portion in said direction radially away from the induction coil.

12. The induction coil loading arrangement of claim 10 wherein said urging of said lever first portion is leveraged such that said axial force is significantly greater than a force applied for said urging.

13. The induction coil loading arrangement of claim 10 wherein said frame includes a plurality of vertical support columns provided about the induction coil, said at least one clamping assembly includes a plurality of clamping assemblies each mounted to one of said plurality of vertical support columns, and said lever of said at least one clamping assembly pivotally mounted to a corresponding support column.

14. The induction coil loading arrangement of claim 13 wherein a plurality of intermediate yokes are mounted to each of said plurality of vertical support columns to apply a radially inward force on the induction coil.

15. The induction coil loading arrangement of claim 13 wherein said lever first portion is connected to said corresponding support column by a spring-urged rod in said direction radially away from the induction coil and said lever is pivotally connected to said corresponding support column at a location spaced apart from said spring-urged rod thereby leveraging a force applied by said spring-urged rod to apply said axial force onto the induction coil through said second portion.

16. A coreless induction furnace having an induction coil loading arrangement, comprising a crucible for holding a material to be heated;

an induction coil wound about said crucible;

a frame supporting said crucible and said induction coil wound about said crucible; and a plurality of clamping assemblies for providing a leveraged axial force to an upper side of said induction coil, each of said plurality of clamping assemblies having a lever and a pivotal connection between said lever and said frame, said lever having a first leg extending downward relative to said pivotal connection and a second leg extending toward an upper axial end of said induction coil, said pivotal connection allows a force applied to said lever first leg to be leveraged and applied to said upper axial end of said induction coil.

17. The coreless induction furnace of claim 16 wherein said frame includes a plurality of vertical support columns, each of said plurality of vertical support columns includes one of said plurality of clamping assemblies, each of said clamping assemblies includes a rod having one end fixedly secured to said lever first leg and the other end movably secured to an adjacent one of said plurality of vertical support columns, each of said clamping assemblies further including an urging mechanism for applying said force to said lever first leg, which is leveraged and applied to said upper axial end of said induction coil by said lever second leg and through said pivotal connection.

18. The coreless induction furnace of claim 16 wherein a lower axial end of said induction coil is axially fixed so that said force leveraged and applied to said upper axial end of said induction coil compresses said induction coil.

* * * * *